United States Patent [19]

Bohan, Jr. et al.

[11] 4,432,722

[45] Feb. 21, 1984

[54] INTERRUPTED POWER HOT WIRE GAS IGNITION CONTROL SYSTEM

[75] Inventors: John E. Bohan, Jr., Minneapolis; Brian J. Hinton, Crystal, both of Minn.

[73] Assignee: Honeywell Inc., Minneapolis, Minn.

[21] Appl. No.: 282,566

[22] Filed: Jul. 13, 1981

[51] Int. Cl.[3] ..... F23Q 9/08

[52] U.S. Cl. ..... 431/46; 431/66; 431/74

[58] Field of Search ..... 431/42, 43, 45, 46, 431/66, 71, 74, 75, 78; 307/117; 340/577, 579

[56] References Cited

U.S. PATENT DOCUMENTS

| | | | |
|---|---|---|---|
| 3,083,758 | 4/1963 | Steghart et al. . | |
| 4,078,879 | 3/1978 | Dietz | 431/71 X |
| 4,087,230 | 5/1978 | Matthews | 431/46 |
| 4,188,181 | 2/1980 | Rippelmeyer et al. | 431/66 |
| 4,194,875 | 3/1980 | Hewitt | 431/45 |
| 4,235,586 | 11/1980 | Hirsch | 431/71 |
| 4,289,476 | 9/1981 | Visos et al. | 431/66 |
| 4,298,335 | 11/1981 | Riordan et al. | 431/45 X |
| 4,306,853 | 12/1981 | Rippelmeyer | 431/66 |

*Primary Examiner*—Samuel Scott
*Assistant Examiner*—Margaret A. Focarino
*Attorney, Agent, or Firm*—Alfred N. Feldman

[57] ABSTRACT

A hot wire type of gas ignition system uses a negative temperature coefficient resistor-ignitor element that is deenergized after ignition has occurred. The ignition and safety monitoring of the circuit is accomplished by a second flame detector means, and the flame responsive circuit that has been disclosed in a flame rectification circuit.

10 Claims, 1 Drawing Figure

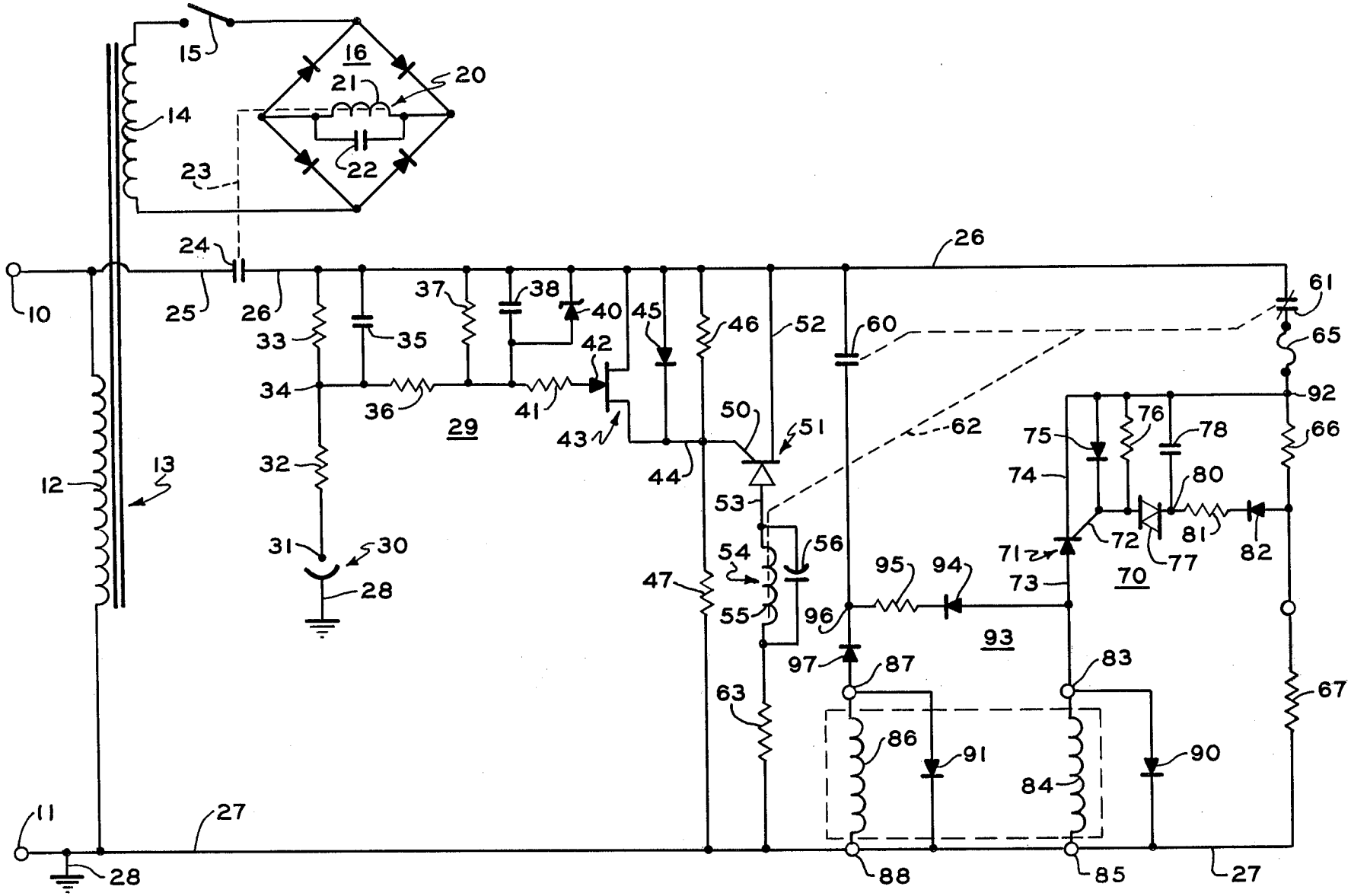
10
11
12
13
14
15
16
20
21
22
23
24
25
26
27
28
29
30
31
32
33
34
35
36
37
38
40
41
42
43
44
45
46
47
50
51
52
53
54
55
56
60
61
62
63
65
66
67
70
71
72
73
74
75
76
77
78
80
81
82
83
84
85
86
87
88
90
91
92
93
94
95
96
97

INTERRUPTED POWER HOT WIRE GAS IGNITION CONTROL SYSTEM

BACKGROUND OF THE INVENTION

In recent years the cost and availability of gas as a fuel has forced drastic conservation measures in its use. In the past, standing pilots have been used extensively in gas fired equipment. A standing pilot is nothing more than a pilot burner that is continuously lit and which is monitored by a bulb and fill, a thermocouple, or similar safety device. The standing pilot has been used because of its very low cost and its reliability.

The standing pilot utilizes gas continuously and, therefore, has been deemed to be an inefficient and expensive use of this fuel. In many states the standing pilot has been legislated out of existence. In order to meet the legislative and economic demands for a better pilot system, a number of other approaches have been used. Typical of these other approaches are spark ignition systems which light a pilot and then allow a main burner to become energized. The spark ignition systems have numerous problems including the generation of radio frequency interference and audible noise which make them objectionable. In addition to spark ignition systems, hot wire ignitors have been used for many years. Hot wire ignitors have proved unreliable due to the deterioration of the ignitor itself, thereby causing high maintenance costs in replacing the ignitor.

Hot wire or hot surface type ignitors have been used in intermittent applications where a pilot burner is ignited and then the hot wire is deenergized to remove the potential on the wire so as to improve the ignitor's life. Ceramic types of negative temperature coefficient resistors have come into use to replace wires. Negative temperature coefficient ceramic resistors can be energized to generate ignition temperatures and withstand the operating conditions in a superior and more economical fashion than other types of hot wires. While there are some physical differences between an actual hot wire and a ceramic resistance type device, they generally both have been referred to as hot wire type devices. The negative temperature coefficient resistors can be used in systems where the resistance element provides for both an ignition and monitoring function. In some systems it has been common to use a negative temperature coefficient resistor-ignitor element for ignition purposes, and then monitor the resistance of that element as a means of detecting flame. This type of system is theoretically workable, but in practice the life of the resistor-ignitor element is so limited that it limits its use in a practical burner ignition arrangement.

The deficiencies of the actual hot wire type devices and the negative temperature coefficient resistor-ignitor elements which have been used can only be overcome if a way can be found to lengthen the life of the ignition element itself.

SUMMARY OF THE INVENTION

The present invention is directed to a system for the control of power to an ignition element. The power to the ignitor is supplied through a series combination of a normally closed relay contact and a resistor. As the ignitor approaches the ignition temperature for gas, its resistance decreases measurably. This decrease in resistance allows for a reduction in a voltage drop across the ignitor element with a related increase in voltage appearing across the series resistance. This increase in voltage is used to control a switching circuit that operates the pilot valve section of a valve means. The pilot valve section is opened and ignition occurs at the ignitor element.

In prior art devices the ignitor element would also act as a sensor and therefore would have to be kept energized. In the present system a separate flame detector is mounted adjacent the burner and detects the presence or absence of flame. When flame appears, the flame detector means operates through a flame responsive circuit means to control a second switching arrangement. This second switching arrangement is typically a solid state switch means to control a relay. The relay has a pair of contacts. The first contact is the normally closed contact that is in the series energizing circuit for the ignitor element. The second contact is a normally open contact that is in turn closed upon the detection of flame. The closing of the normally open contact provides power to the main valve section. The closing of this contact also completes a holding circuit for the pilot valve device along with the interruption of power to the ignitor element. This allows the ignitor element to be energized only during the ignition phase of operation and ensures a long life for the ignitor element.

The present invention basically entails the use of a hot wire ignitor system for the initiation of the pilot flame while utilizing a flame detector means that is separate from the ignitor to maintain the operation of the pilot and burner, while at the same time deenergizing the hot wire ignitor element to improve its life and reliability.

BRIEF DESCRIPTION OF THE DRAWING

The single FIGURE is a schematic diagram of a complete ignition control system.

DESCRIPTION OF THE PREFERRED EMBODIMENT

The single schematic diagram disclosed is a complete interrupted power hot wire gas ignition control system. The term hot wire has been used in the present specification as a generic term for any type of negative temperature coefficient resistor-ignitor element whether it be in fact a wire or a ceramic type of ignitor element. The early hot wire ignitor elements were in fact nickel-chromium type wires and these ignitors have utility in certain types of applications. In more recent years a ceramic type of negative temperature coefficient resistor-ignitor element has been developed for use in gas ignition. Regardless of which type of unit is used, the term hot wire gas ignitor will be used throughout the present description as generic to this general class of ignitor elements.

A pair of line voltage terminals 10 and 11 are provided that are connected to a primary winding 12 of a transformer generally disclosed at 13 which further has a low voltage winding 14. The winding 14 is connected through a switch 15 to a diode bridge generally disclosed at 16. The bridge has a relay means disclosed at 20 which includes a relay coil 21 and a parallel capacitor 22 that ensures proper operation of the relay means 20. The relay means 20 further has a mechanical coupling 23 to a normally open contact 24. The relay contact 24 is connected by a conductor 25 to the line voltage terminal 10. The transformer means 13 and the switch 15 along with the bridge 16 and the relay means 20 allows for low voltage operation of the contact 24 which in turn operates in a line voltage environment.

The switch 15 typically would be a thermostat in a residential installation and would be operated from a 24 volt secondary 14 in a conventional manner. The contacts 24 of the relay means 20 could be replaced by a line voltage switch that is either manually operated or thermostatically operated if that is desired. The only essential element is that a means of connecting the terminals 10 and 11 to a pair of conductors 26 and 27 be provided so that line voltage is provided between conductors 26 and 27. The conductor 27 is disclosed as grounded at 28 in a conventional manner.

A flame detector means is generally disclosed at 30 as a flame rectification type in which a portion of the device is grounded at 28, and the other portion of the device at 31 is connected through a pair of resistors 32 and 33 to the conductor 26. This forms an input circuit for a flame responsive circuit means disclosed at 29. As is well known, a flame rectification system operates on the principle that when an alternating current is applied across a flame, the flame allows conduction of a greater magnitude in one direction than in the other of the applied alternating current voltage. This results in what appears to be a rectified flame conducted current, and this principle allows for the generation of a voltage across the resistor 33 that is a function of whether a flame exists at the flame detector means 30 or not. The voltage across the resistor 33 is provided at a junction 34 to a network made up of a capacitor 35, a resistor 36, a further resistor 37, and a capacitor 38. The voltage across the capacitor 38 is stabilized by a zener diode 40 and is applied through a resistor 41 to a gate 42 of a field effect transistor 43. The voltage therefore that appears at the junction 34 is used to control the field effect transistor 43 by applying a voltage at the gate 42 that is capable of causing the field effect transistor 43 to either be a substantially open circuit or a substantially closed circuit.

The voltage across the field effect transistor 43 is supplied at a conductor 44 to a parallel combination of a diode 45 and a resistor 46. The resistor 46 is connected to a further resistor 47 that is connected to the ground conductor 27. The voltage that is divided between the resistors 46 and 47 is supplied at a conductor 44 to a gate 50 of a silicon controlled rectifier 51. The silicon controlled rectifier 51 is connected by a conductor 52 to the conductor 26. The arrangement described to this point is a flame detector means 30 and a flame responsive circuit means 29 which has an input 34 that is connected to the flame detector means 30 and has a switched output means in the form of the silicon controlled rectifier 51 along with a relay means disclosed at 54. The relay means 54 includes a relay coil 55 that has a stabilizing capacitor 56 and a pair of contacts 60 and 61. The contact 60 is a normally open contact, while the contact 61 is a normally closed contact. The contacts 60 and 61 are mechanically linked at 62 to the relay means 54. The relay means 54 is energized by connection between the silicon controlled rectifier 51 and a resistor 63 that connects the relay coil 55 to the ground conductor 27.

The normally closed relay contact 61 is connected to the power conductor 26 and to a fuse 65 along with a resistor 66 and a hot wire gas ignition element 67 that is a negative temperature coefficient resistor-ignitor element, preferably of the ceramic type. As was previously mentioned the particular type of resistor-ignitor element 67 is not material. The normally closed contact 61, the fuse 65, the resistor 66, and the resistor-ignitor element 67 are connected in a series circuit across the power conductors 26 and 27. Since the resistor-ignitor element 67 is a negative temperature coefficient element, it will become apparent that as current flows through the series circuit that the voltage that appears across the resistor-ignitor element 67 decreases and a voltage increases across the resistor 66. This function becomes important in the operation of the system and will be described after the entire circuit has been defined.

The resistor 66 acts as an input to a switch means generally disclosed at 70. The switch means 70 includes a silicon controlled rectifier disclosed at 71 which has a gate 72, an anode 73, and a cathode connection 74. The cathode 74 is connected to the gate 72 by a parallel combination of a diode 75 and a resistor 76 which act as gating elements for the silicon controlled rectifier 71. Connected across the resistor 76 is a bilateral switch 77 and a capacitor 78. The bilateral switch 77 is used to allow a charge to build on the capacitor 78, in a manner that will be seen. A connection between the bilateral switch 77 and the capacitor 78 at 80 is connected through a resistor 81 and a diode 82 so that the capacitor 78 is connected across the resistor 66. A voltage appearing across the resistor 66 charges of the capacitor 78 until the bilateral switch 77 allows discharge of the capacitor 78 through the resistor 76. This provides a gating potential at the gate 72 of the silicon controlled rectifier 71. This switch means, that is the switch means 70, is connected to a termnal 83 that in turn is connected to a pilot valve 84 that has a further terminal 85 connected to the ground conductor 27. The pilot valve 84 is operated with a main valve 86 that has a pair of terminals 87 and 88 to connect the main valve 86 in the circuit. Each of the valves 84 and 86 is paralleled by a diode 90 and 91 to ensure proper operation of the valve during alternate half cycles of the applied alternating current between the terminals 10 and 11. The pilot valve 84 and the main valve 86 are mechanically arranged so that the pilot valve 84 must be open to supply gas to a pilot burner before the main valve 86 will open. This is a standard type of valve structure. It will be noted that the pilot valve 84 is connected to the silicon controlled rectifier 71, which in turn connects it to a point 92 which effectively is connected to the conductor 26 through the fuse 65 and the normally closed relay contact 61. The operation of the switch means 70 will clearly energize the valve 84, and the manner in which it is operated will be described after the balance of the circuit has been disclosed.

An impedance means 93 is disclosed including a diode 94 and a resistor 95 which is connected from the anode 73 of the silicon controlled rectifier 71 to a junction 96 which is between a diode 97 and the normally open relay contact 60. The impedance means 93 is used to maintain the operation of the pilot valve 84 when the circuit is in operation.

OPERATION

A brief explanation of operation is provided and is believed sufficient for this circuit. When the thermostat or switch 15 is closed, the relay contact 24 closes applying power between the conductors 26 and 27. A series circuit including the normally closed relay contact 61, the fuse 65, the resistor 66, and the resistor-ignitor element 67 is completed. Initially most of the voltage is dropped across the resistor-ignitor element 67. As the resistor-ignitor element 67 increases towards an ignition temperature, the voltage across it drops and the voltage across the resistor 66 increases. When the voltage across resistor 66 increases sufficiently to break down the bilateral switch 77, the silicon controlled rectifier conducts energizing the pilot valve 84. This introduces gas to the hot resistor-ignitor element 67 where ignition then occurs and a pilot flame then is established.

The pilot flame is sensed by the rectification flame sensing detector means 30, and a voltage is supplied at the junction 34 for the flame responsive circuit means 29 thereby causing the silicon controlled rectifier 51 to conduct. This is accomplished by cutting off the conduction in the field effect transistor 43 and allowing the voltage developed in the voltage divider 46 and 47 to apply voltage at the gate 50 of the silicon controlled rectifier 51 to pull in the relay means 54. When the relay 54 is energized, the normally open relay contact 60 closes, while the normally closed relay contact 61 opens. This operation provides a direct energizing path through the contact 60 and diode 97 to the main valve 86 while opening the series circuit in which the normally closed relay contact 61 has been supplying power to the resistor-ignitor element 67. The impedance means 93 provides a conduction path at a reduced voltage for the pilot valve 84 to keep the pilot valve energized once it has been energized. This is necessary since the silicon controlled rectifier 71 of the switch means 70 is deenergized when the normally closed relay contact 61 is opened upon the sensing of flame.

With the arrangement just described a resistor-ignitor element 67 can be interrupted in its operation and thereby can provide a device with a very long ignition life. The present system has been disclosed as operated with a thermostat or low voltage switch 15 to control the line voltage contact 24. The line voltage contact 24 obviously could be replaced by a line voltage control device and the low voltage section including the transformer means 13, the bridge 16, the relay means 20 and its associated circuitry could be eliminated. Other variations in the present circuit could be accomplished by modifying the type of flame detector used, and the type of electronic or electric switching used. Since the present circuitry can be modified by one skilled in the art the inventors wish to be limited in the scope of their invention to the scope of the appended claims.

The embodiments of the invention in which an exclusive property or right is claimed are defined as follows:

1. An interrupted power hot wire gas ignition control system adapted to control a burner having gas valve means incorporating a pilot valve and a main valve, including: a negative temperature coefficient resistor-ignitor element which when energized from a potential changes in resistance value as the resistor-ignitor element heats to an ignition temperature with said element mounted at said burner; a series ignition circuit including a normally closed relay contact, a resistor, and said resistor-ignitor element with said ignition circuit adapted to be connected to a source of potential upon operation of said burner; switch means connected to energize said pilot valve; switch control circuit means connected to said resistor to control said switch means, and wherein said switch means is nonconductive when said resistor-ignition element is cold, and further wherein said switch means is conductive to energize said pilot valve when said resistor-ignition element is at a gas ignition temperature; flame detector means mounted at said burner to detect the presence of a flame when said pilot valve has opened with said resistor-ignitor element at said gas ignition temperature; flame responsive circuit means having an input connected to said flame detector means, and said flame responsive circuit means having switched output means; said switched output means including a relay having a normally open relay contact, and further including said normally closed relay contact; said normally open relay contact connected to said main valve to allow said normally open relay contact when closed to energize said main valve; and impedance means including a diode connecting said pilot valve to said normally open relay contact; said relay being energized upon the sensing of flame at said burner by said flame detector means with said normally closed relay contact becoming open circuited to remove power from said resistor-ignitor element while said normally open relay contact becomes closed circuited to maintain said pilot valve energized through said impedance means, and to also energize said main valve.

2. A hot wire gas ignition control system as described in claim 1 wherein said switch means includes solid state switch means; and said flame responsive switch output means includes solid state switch means to control said relay.

3. A hot wire gas ignition control system as described in claim 2 wherein said solid state switch means each include a silicon controlled rectifier.

4. A hot wire gas ignition control system as described in claim 2 wherein said flame detector means is flame rectification detector means which controls said flame responsive circuit means.

5. A hot wire gas ignition control system as described in claim 4 wherein said impedance means includes a series connected resistor and said diode.

6. A hot wire gas ignition control system as described in claim 5 wherein said series ignition circuit further includes line voltage switch means which is open circuited in the absence of the need of the operation of said burner, and said line voltage switch means being close circuited when said burner is in operation; and said line voltage switch means being operated by low voltage control means.

7. A hot wire gas ignition control system as described in claim 6 wherein said low voltage control means includes a low voltage relay, and said line voltage switch means is a relay contact of said low voltage relay to allow operation of said burner from a line voltage source of potential by said low voltage relay.

8. A hot wire gas ignition control system as described in claim 7 wherein said series ignition circuit includes overload protection means.

9. A hot wire gas ignition control system as described in claim 8 wherein said overload protection means is a series connected fuse.

10. A hot wire gas ignition control system as described in claim 8 wherein said solid state switch means each include a silicon controlled rectifier.

* * * * *